US005636836A

United States Patent [19]

Carroll et al.

[11] Patent Number: 5,636,836

[45] Date of Patent: Jun. 10, 1997

[54] HOCKEY STICK SHAFT

[75] Inventors: William J. Carroll, Chardon; David E. Green, Bedford, both of Ohio

[73] Assignee: Glastic Corporation, Cleveland, Ohio

[21] Appl. No.: 467,723

[22] Filed: Jun. 6, 1995

[51] Int. Cl.[6] ..... A63B 59/12

[52] U.S. Cl. ..... 473/561

[58] Field of Search ..... 273/67 A; 473/316, 473/317, 318, 319

[56] References Cited

U.S. PATENT DOCUMENTS

| | | | |
|---|---|---|---|
| 2,304,322 | 12/1942 | Werlich | 273/67 A |
| 4,059,269 | 11/1977 | Titola | 273/67 A |
| 4,591,155 | 5/1986 | Adachi | 273/67 A |
| 4,684,130 | 8/1987 | Drolet | 273/67 A |
| 4,968,032 | 11/1990 | Redekop | 273/67 A |
| 5,050,878 | 9/1991 | Deleris | 273/67 A |
| 5,160,135 | 11/1992 | Hasegawa | 273/67 A |
| 5,217,221 | 6/1993 | Baum | 273/67 A |
| 5,303,916 | 4/1994 | Rodgers | 273/67 A |
| 5,333,857 | 8/1994 | Lallemand | 273/67 A |

*Primary Examiner*—Theatrice Brown

*Attorney, Agent, or Firm*—D. Peter Hochberg; Mark Kusner; Michael Jaffe

[57] ABSTRACT

A composite hockey stick shaft of generally uniform cross section along a longitudinal axis having a first pair of opposing sides perpendicular to a neutral bending axis, and a second pair of opposing sides parallel to the neutral bending axis, wherein the first pair of opposing sides has a lower compressive strength and strain than the second pair of sides.

39 Claims, 2 Drawing Sheets

HOCKEY STICK SHAFT

FIELD OF THE INVENTION

This invention relates to a hockey stick and a hockey stick shaft. More particularly, this invention relates to a composite hockey stick shaft.

BACKGROUND OF THE INVENTION

One piece, wooden hockey sticks have the feel, weight and physical characteristics such as flexibility and stiffness that hockey players have found desirable since the inception of the game. Unfortunately, one piece wooden hockey sticks tend to break, necessitating the replacement of the stick during the game.

It is desirable to develop a hockey stick that has the feel, weight and physical characteristics of a wooden hockey stick with improved strength characteristics. Hockey sticks shafts have been made of aluminum, polymeric materials, filled and reinforced polymeric materials and fiber reinforced polymeric materials. The shafts of these hockey sticks are hollow and can be made such that a replaceable wooden or plastic blade may be inserted into the shaft if the blade is broken or if the blade should be changed for some other reason.

Pultruded hockey stick shafts made of reinforced polymeric materials capable of receiving a replaceable handle and/or blade are known in the art. A pultruded, hockey stick shaft made of fiber reinforced polymeric materials is known. The use of layers of glass fiber (or fiberglass) and carbon fiber in all four sides of the pultruded shaft of a hockey stick is also known.

SUMMARY OF THE INVENTION

It is an object of this invention to provide a hockey stick shaft that has the feel, weight and physical characteristics of a wooden hockey stick shaft but with enhanced strength.

It is a further object of this invention to provide a composite hockey stick shaft with the above referenced properties.

It is a further object of this invention to provide a composite shaft for a sporting instrument adapted to be swung or otherwise moved, such as a composite hockey stick shaft, having a lower compressive strength and strain on portions of the sides generally perpendicular to the neutral bending axis of the shaft than the compressive strength and strain on portions of the sides generally parallel to the neutral axis.

Yet still another object of the invention is to provide a shaft as described above having on the portions of the sides lying perpendicular to the neutral bending axis layers of glass fibers and carbon fibers as reinforcing members, and having on the portions of the sides lying parallel to the neutral bending axis layers of glass fibers only, with fewer or no carbon reinforcing fibers or other reinforcing fibers.

It is still a further object of the invention to provide a shaft as described above where the reinforcing fibers in the side portions perpendicular to the neutral bending axis of the shaft can extend into or around the corners extending to the side portions parallel to the neutral bending axis.

It is a further object of this invention to provide a hockey stick having a shaft with reinforcing fibers having different tensile strengths or compressive strengths, as exhibited in a composite such as Kevlar (a trademark of DuPont), used instead of carbon fibers as used above, or in combination with glass fibers.

It is a further object of this invention to provide a hockey stick and shaft as described above, wherein the resin used as a matrix for the fiber reinforcing elements is a thermosetting, polymeric material or a thermoplastic, polymeric material.

Another object is to provide a hockey stick shaft of desirable characteristics which can be pultruded.

A general object of the invention is to provide an improved shaft as described above which is effective in use, yet capable of being made in an economical and practicable manner.

DETAILED DESCRIPTION OF THE DRAWINGS

The invention may take physical forms in certain parts and arrangement of parts, embodiments of which will be described in detail in the specification and illustrated in the accompanying drawings wherein.

DETAILED DESCRIPTION OF THE PREFERRED EMBODIMENT

Figure 1:
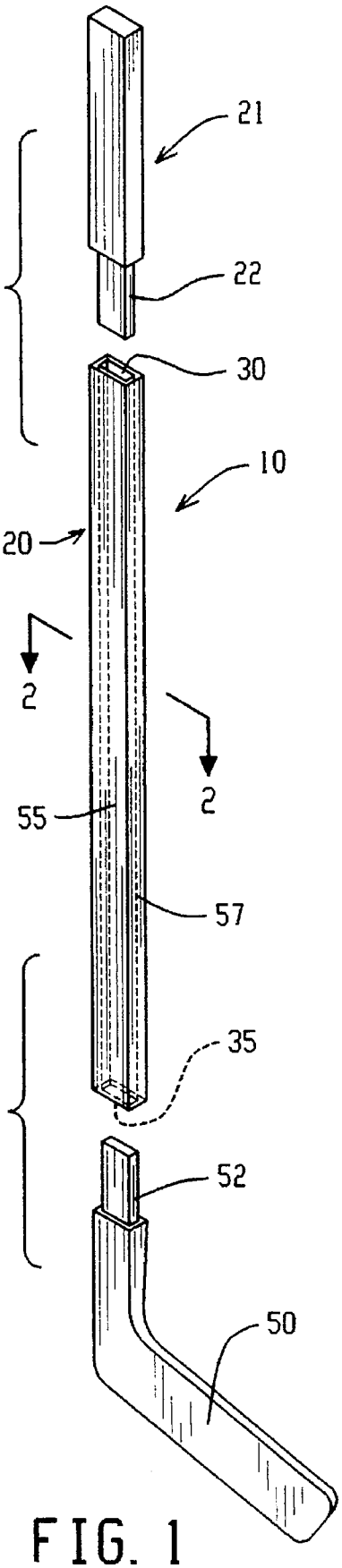
FIG. 1 shows a hockey stick, partly shown in section, incorporating the shaft of the present invention.

The present invention relates to a composite shaft for sporting equipment such as a hockey stick shaft, which must be moved quickly to impact another object such as a hockey puck. The shaft usually has a rectangular cross section, but can have other numbers of sides or have a curvilinear exterior (with sections thereof being considered as "sides" for the discussion herein). The surface of the shaft could be equidistant from its longitudinal central axis, or could be off center such as where it is in the shape of an oval or is eccentric. The shaft could have parallel sides, or it could taper or have thinner and thicker sections along its length. The central axis of the shaft could be straight, or it could vary along its length.

The composite shaft pursuant to the invention has a neutral bending axis along the cross section of the shaft (the neutral bending axis is an imaginary surface extending along the length of the shaft) with one pair of sides generally perpendicular to the neutral bending axis and another pair of sides generally parallel to the neutral axis. The shaft has an interior which is of lower density than the sides and could be hollow. The pair of sides perpendicular to the neutral bending axis is composed of reinforcing fibers. The fibers in the pair of sides perpendicular to the neutral bending axis has lower compressive strength and strain than the fibers of the pair of sides parallel to the neutral bending axis.

Referring now to the drawings wherein the purpose is the showing of a preferred embodiment of the present invention only, and not for the purpose of limiting the same, FIGS. 1, 2A, 2B, 2C and 3 illustrate a hollow, pultruded, composite hockey stick shaft illustrating a preferred embodiment of the present invention.

Broadly stated, the hockey stick 10 of FIG. 1 is comprised of a hockey stick shaft 20; a handle 21 having a neck 22 that is inserted into an opening 30 of shaft 20; and a blade 50 having a neck 52 that is inserted into an opening 35 of shaft 20. The handle 21, the neck 22 of the handle, the blade 50, and the neck 52 of the blade 50 may be made of wood, plastic, filled plastic, extended plastic or fiber reinforced plastic. The two openings 30 and 35 receive, respectively, the neck 22 of the handle and the neck 52 of the blade 50 so that in the event the handle or the blade is broken during the game, either may be replaced in the shaft 20 of the hockey stick 10. The necks of the handle and the blade are typically glued into openings 30 and 35.

Figure 2A:
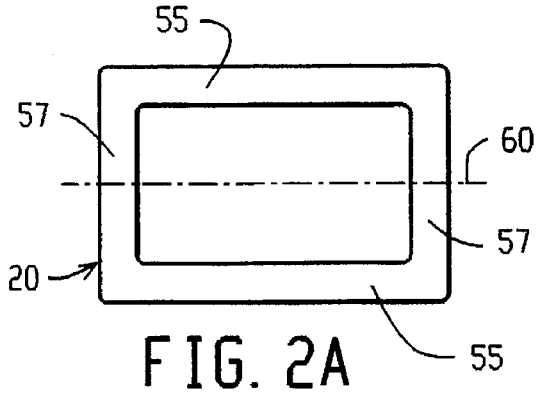
FIGS. 2A, 2B and 2C are sectional views of line 2—2 of FIG. 1 showing, respectively, the neutral bending axis and two forms of the preferred embodiment.
Figure 2B:
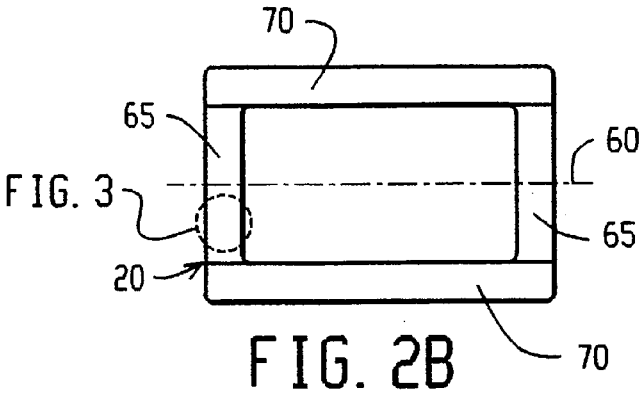
Figure 2C:
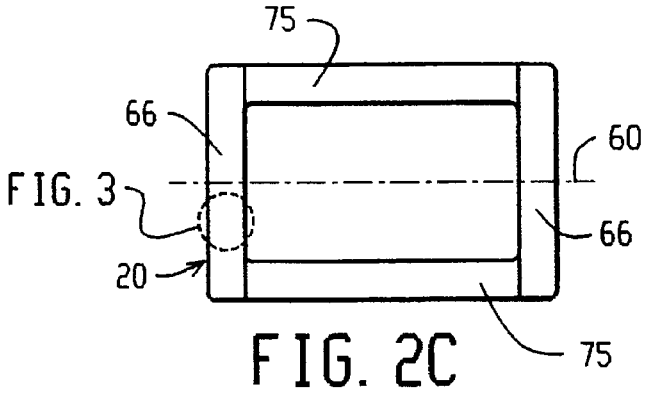

FIGS. 2A, 2B, and 2C are cross-sectional views of the hockey shaft 20. FIG. 2A is a cross-section of a prior art hockey stick shaft, and FIGS. 2B and 2C are alternate forms of the preferred embodiment of the invention. Any portion of the material of the hockey stick shaft that lies between the outer perimeter and the inner perimeter of the cross-section of the shaft is defined as a region.

Figure 3:
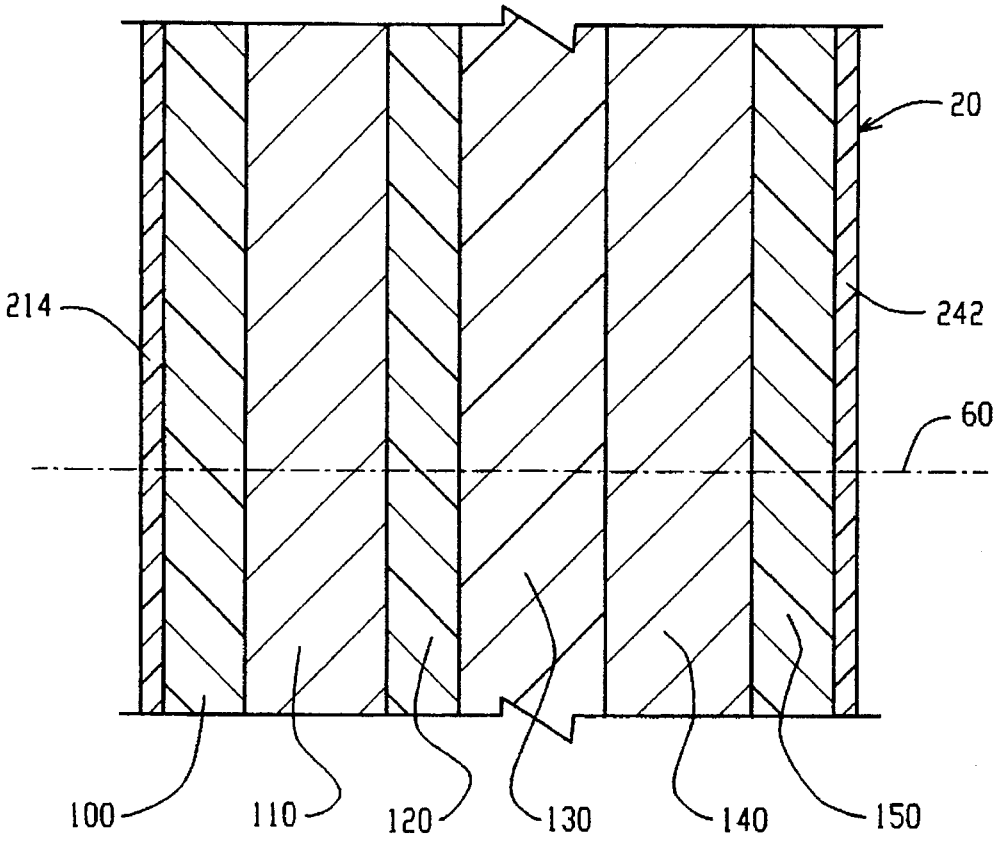
FIG. 3 is an enlarged fragmentary detail of section 3 of FIGS. 2B and 2C.

FIG. 3 is an exploded compositional view of the layered structure of the sides of the hockey stick shaft perpendicular to the neutral bending axis 60 of the hockey stick shaft 20.

The neutral bending axis of the shaft is a bisecting axis of the shaft that lies in the plane of the cross-section and that is parallel to the blade of the hockey stick. The bisector axis that is perpendicular to the neutral bending axis and that lies in the plane of the cross-section of the hockey stick shaft intersects the neutral bending axis at the geometrical center of the hockey stick shaft. A third bisector of the shaft runs parallel to the longitudinal axis of the hockey stick shaft and intersects the cross-sectional area at right angles.

Referring to FIG. 2A, the hockey stick shaft 20 is shown having sides 55 parallel to the neutral bending axis 60 and sides 57 perpendicular to the neutral bending axis 60. Sides 55 of a version of the hockey stick shaft 20 are about 1.18 inches wide and sides 57 are about 0.79 inches wide. The wall thickness of shaft 20 is substantially uniform and may vary from about 0.070 to 0.090 inches. Substantially any thickness is possible. The desired weight of the hockey stick would limit the upper limit thickness of the shaft; the strength of the shaft would limit the lower limit thickness of the shaft. For example, smaller players would like smaller sticks. Also, the sides and their thicknesses could vary depending on the desired end properties of the stick. In some cases, it would be desirable to make the wider sides of the stick a different thickness than the shorter sides.

It has been determined that the placement of different fibers within a composite hockey stick shaft affects its performance. It is believed that the placement of carbon fibers towards the neutral bending axis adds to the durability of the hockey stick during use. Hockey sticks become more prone to failure under compression as a result of bending when the carbon fibers are placed away from the neutral bending axis, that is, toward the outside surface of the hockey stick.

It has been further discovered that the placement of carbon fibers within the sides of the hockey stick that are parallel to the neutral bending axis results in a lower deflection of the hockey stick. This leads to the undesirable result that the hockey stick becomes more prone to failure from the fatigue of repeated bending.

It is to be appreciated that combinations of reinforcing materials having different compressive strengths other than carbon fiber and fiberglass such as Kevlar fibers and fiberglass may be used in this invention. Off axis fibers (such as ±45°, for example) could be made of many different materials such as glass fiber, Kevlar, carbon fiber and the like.

In this invention, it has been discovered that the fatigue and deflection properties required to maximize the durability of the hockey stick may be attained by confining the use of carbon fibers or other reinforcing materials (or a combination of carbon fibers and other reinforcing materials) to the sides that are perpendicular to the neutral bending axis. This aspect of the invention is illustrated in FIGS. 2B and 2C.

FIGS. 2B and 2C show two different ways of constructing the hockey stick shaft of the preferred embodiment of this invention. In FIG. 2B, sides 70, which are parallel to the neutral bending axis 60 of the shaft, are constructed of layers of glass fiber only and no carbon fiber. Sides 65, which are perpendicular to the neutral bending axis of the hockey stick shaft, are comprised of a combination of glass fiber layers and at least one carbon fiber (or other reinforcing fiber) layer. In FIG. 2B, sides 70 are approximately 1.2 inches long and sides 65 are approximately 0.8 inches long. Side 70 represents the entire width; however, this dimension would increase if the carbon fibers went partially around the corner.

In FIG. 2C, sides 75, which are parallel to the neutral bending axis of the hockey stick shaft, are comprised of glass fiber layers only and no carbon fiber, with respect to those fibers extending parallel to the neutral bending axis. Sides 66, which are perpendicular to the neutral bending axis of the hockey stick shaft, are comprised of glass fiber layers and at least one carbon fiber layer. In FIG. 2C, the maximum placement of sides 66 around the corners is not to exceed the end of the corner radius. In FIG. 2C, sides 75 and sides 66 are the same lengths as those in FIG. 2B.

Figure 4:
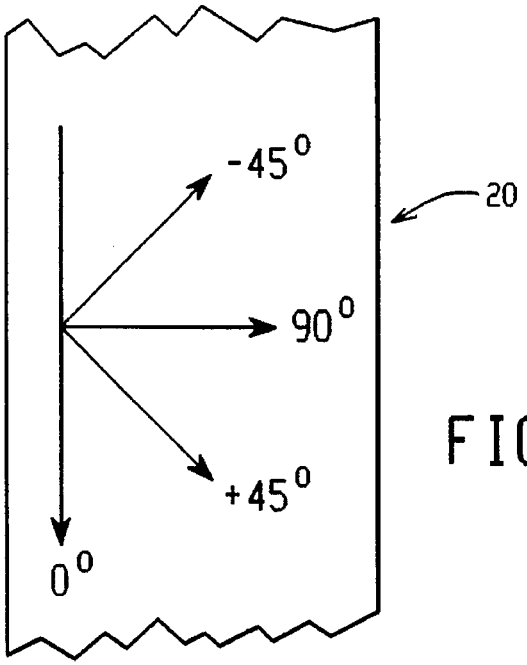
FIG. 4 is a schematic of the hockey stick shaft showing the angular direction of the layup materials that comprise the hockey stick shaft.

FIG. 3 illustrates the preferred layup sequence for the hockey stick shaft of this invention. FIG. 3 is to be read in conjunction with FIG. 4 which shows the angular directions of the fibers in the hockey stick shaft.

FIG. 3 illustrates the preferred layup sequence of the sides of the hockey stick shaft of this invention that lie in a direction that is perpendicular to the neutral bending axis. Starting with layer 100 which is the innermost layer of hockey stick shaft 20 and moving outward to layer 150, layer 100 is preferably comprised of a ±45° balanced, stitched layered or woven glass fiber fabric. Layer 110 is preferably comprised (on sides 65 or 66) of carbon fiber, although it could be a combination of 0° fiberglass and carbon fiber. The volume percentages of each do not make a substantial difference. Layer 120 is preferably comprised of a ±45° balanced, layered glass fiber fabric. It is preferably stitched, but woven (including braided) fabric may be used. Layer 130 is preferably comprised of a layer of 0° and 90° glass fiber fabric. Layer 140 is the same as layer 110. Layer 150 is comprised of a layer of ±45° stitched or woven fiberglass. The preferred resin to bond these layers together is an epoxy resin.

The weight of the hockey stick shaft can relate to the thickness of its walls and generally is not important with respect to the present invention. The number of fibers in the rovings is generally not important, and various commercially available rovings are adequate. As discussed above, woven materials or materials with raised layers may be used in place of stitched materials.

In the preferred embodiment, lays 110 and 140 are the most important, the others are discretionary. As discussed below, shafts pursuant to the invention are advantageously made by pultrusion. As noted earlier, resin such as epoxy resin can be used to bond the layers. The temperatures in the pultrusion process, the types of epoxy resins used, the weight percentages of the epoxy resin to the weight of the final shaft, the use of other resins and the production speeds are not crucial to the invention and are known to those skilled in the art. The chemicals used to cure the epoxy resins, termed cross-linking agents, include amines, amides and anhydrides.

Hockey stick shafts according to the present invention are preferably made with a pultrusion system. Lamination and impregnation processes are used to make the hockey stick shaft. The apparatus would be employed to pull a laminated and impregnated fiber reinforced, continuous product through the process system.

The pultrusion system would advantageously comprise devices for urging the glass fibers, carbon fibers and other fibers, rovings and fiber mats into the structure of the hockey stick shaft. The rovings and mats can include fibers extending in different angular relationships to the mat and to each other. These fibers, rovings and mats can be formed and layered or laminated by one or more forming stations. Fibers can be directed to have different angular relationships to the neutral bending axis of the hockey stick shaft. The fibers, mats and combinations thereof, such as in laminate form, can be subjected to an impregnation process where they can be impregnated with a resin. If the core of the hockey stick shaft is to have a rectangular cross section, the fibers and mats can be directed around a mandrel having a rectangular periphery dimensioned to produce hockey stick shafts with the desired rectangular core.

As mentioned above, the preferred cross-section of the hockey stick shaft is rectangular. It is contemplated, however, that other cross-sections may be employed. For example, the cross-section could be circular, elliptical, oblong, triangular, square, pentagonal, hexagonal or of higher order prismatic values. The core of the hockey stick shaft could be hollow or empty, or it could include a material of lower density, such as foam made from an appropriate plastic. When other cross-sections are used, the carbon fibers are located on opposite sides of the shaft.

Following impregnation, the hockey stick can be subjected to compression and elevated temperatures in a heat and cure die. The elevated temperatures can initiate a cross-linking reaction. The product could exit the heat and curing die in a solid state. This product would be advanced by the puller to a saw and cut into predetermined lengths to make the final product.

A polyester fabric or veil, or other common veiling material, can be incorporated on the work in process in the pultrusion system for manufacturing the hockey stick shaft. These fabrics can be bonded together and not knit. This fabric or veil can be Nexus produced by the Nexus Corporation. The veil soaks up the resin and places it, rather than the fibers, on the surface of the product. It provides the finished product with a smooth and attractive appearance.

The sides that are parallel to the neutral bending axis have no longitudinal or 0° carbon fibers therein. They are made of layers of fiberglass or other fibers as known in the industry. The exact laminar composition of the sides is not critical to this invention.

A puller can pull the work in process through the system. There are many types of pullers for pultrusion processes known, and the nature of the puller depends upon the pultrusion system used to manufacture the foregoing hockey stick shafts.

Although the preferred method of making the hockey stick shafts of this invention employs the pultrusion process, other methods may be used. For instance, the hockey stick shaft could be made manually in a mold known in the art as a resin-transfer molding process. In this molding process, the part is constructed and the resin is added either during or later in the process. The resin may be applied to the rovings or the mats and then cured.

Another method of making the hockey stick shaft of this invention involves a filament winding process known to the art. In this process, the fibers are wound on a rotating spindle.

Table I indicates other laminar configurations of the constituents of the hockey stick shaft as contemplated by this invention. The laminae are given in order starting from the inside wall to the outside wall of the hockey stick shaft. All of these constructions are for the walls of the shaft that contain carbon fiber as defined in this invention. In the instances where it is indicated that fiberglass or carbon fibers may be present in a particular laminate, it is necessary that carbon fibers be present in at least one of the so indicated laminae.

TABLE I

Construction Number One

1. ±45° FIBERGLASS (ONE OR TWO LAYERS)
2. 0° FIBERGLASS AND CARBON FIBER
3. 0°/90° FIBERGLASS
4. 0° FIBERGLASS OR CARBON FIBER
5. 45° FIBERGLASS (ONE OR TWO LAYERS)

Construction Number Two

1. ±45° FIBERGLASS (ONE OR TWO LAYERS)
2. 0° FIBERGLASS OR CARBON FIBER
3. 0°/90° FIBERGLASS
4. 0° FIBERGLASS OR CARBON FIBER
5. 0°/90° FIBERGLASS

Construction Number Three 1. 0°/90° FIBERGLASS
2. 0° FIBERGLASS
3. ±45° FIBERGLASS (ONE OR TWO LAYERS)
4. 0° CARBON FIBER
5. ±45° FIBERGLASS (ONE OR TWO LAYERS)

Construction Number Four

1. ±45° FIBERGLASS
2. 0° CARBON FIBER
3. ±45° FIBERGLASS
4. 0°/90° FIBERGLASS
5. 0° FIBERGLASS
6. ±45° FIBERGLASS OR 0°/90° FIBERGLASS

This invention provides a hockey stick and a hockey stick shaft with improved physical properties. It also provides a hockey stick shaft that has the desirable feel of a wooden hockey stick shaft. The stick and shaft can be constructed using known processes and tools in an efficient and practicable manner. Although the preferred construction uses 0°/90° and ±45° fiberglass layers, in some instances these layers could be changed or dispensed with. An economical construction for a shaft according to the present invention is to provide at least one layer of 0° glass fiber on the side of the shaft parallel to the neutral bending axis, at least one layer of 0° carbon fiber on the side perpendicular to the neutral bending axis, and at least one additional layer of random fibers which can be on one or both sides of the layers of glass and carbon fibers.

The foregoing and other modifications will occur to others upon a reading and understanding of the specification. It is intended that all such modifications, alterations and applications be included insofar as they come within the scope of the patent as claimed or the equivalents thereof.

Having thus described the invention, the following is claimed:

1. A shaft for sporting equipment including:

a first pair of generally opposed sides perpendicular to a neutral bending axis and a second pair of generally opposed sides parallel to the neutral bending axis, each of said first and said second pairs of sides comprising reinforcing fibers, the first and second pair of sides forming at least part of a shaft having an interior of lower density than the sides, the fibers of said first pair of sides perpendicular to the neutral bending axis having a lower compressive strength and strain than the fibers of said second pair of sides parallel to the neutral bending axis.

2. A shaft according to claim 1 wherein said reinforcing fibers in said first pair of sides are carbon fibers.

3. A shaft according to claim 1 wherein said reinforcing fibers in said first pair of sides are made from Kevlar.

4. A shaft according to claim 1 wherein the first pair of sides perpendicular to the neutral bending axis extend part way around the corner to the adjacent sides.

5. A shaft according to claim 1 wherein said shaft is a rectangle, and first and second pair of sides are included in said rectangle.

6. A shaft according to claim 1 wherein said first and second sides include layers of fibers which are transverse to the longitudinal axis of said shaft.

7. The shaft of claim 6, wherein the shaft is pultruded.

8. The shaft of claim 1, wherein the shaft is pultruded.

9. The shaft of claim 1 wherein the shaft is made by resin-transfer molding.

10. The shaft of claim 1, wherein the shaft is made by filament winding.

11. The shaft of claim 1, wherein the shaft is made by manual molding.

12. The shaft of claim 1, wherein the shaft is made by a hand layup process.

13. The shaft of claim 1, wherein the shaft is made by a mandrel wrap process.

14. The shaft of claim 1, wherein the reinforcing fibers are selected from the group consisting essentially of carbon fibers, Kevlar fibers and combinations thereof.

15. A shaft according to claim 1 wherein said sides comprise layers of bonded fibers, the fibers being oriented with respect to the longitudinal axis of said shaft, said layers comprising:

at least one layer of ±45° glass fibers;

at least one layer of 0° glass fiber on the side parallel to the neutral bending axis and 0° carbon fiber on the side perpendicular to the neutral bending axis;

0° carbon fibers; and at least one layer of 0° glass fibers and carbon fiber.

16. A shaft according to claim 1 wherein said sides comprise layers of bonded fibers, the fibers being oriented with respect to the longitudinal axis of said shaft, said layers comprising:

at least one layer of ±45° glass fibers;

at least one layer of 0° glass fiber on the side parallel to the neutral bending axis and 0° carbon fiber on the side perpendicular to the neutral bending axis; and two layers of fibers.

17. A shaft according to claim 1 wherein said sides comprise layers of bonded fibers, the fibers being oriented with respect to the longitudinal axis, said layers comprising:

at least one layer of ±45° glass fibers;

at least one layer of 0°/90° glass fiber;

at least one layer of 0° glass fiber on the side parallel to the neutral bending axis and 0° carbon fiber on the side perpendicular to the neutral bending axis; and at least one layer of 0°/90° glass fiber.

18. A shaft according to claim 1 wherein said sides comprise layers of bonded fibers, the fibers being oriented with respect to the longitudinal axis, said layers comprising:

at least one layer of ±45° glass fibers;

at least one layer of 0° glass fiber on the side parallel to the neutral bending axis and 0° carbon fiber perpendicular to the neutral bending axis; and at least one layer of 0° glass fiber.

19. A shaft according to claim 1 wherein said sides comprise layers of bonded fibers, the fibers being oriented with respect to the longitudinal axis, said layers comprising:

at least one layer of 0°/90° glass fibers;

at least one layer of 0° glass fiber;

at least one layer of 0° carbon fiber on the side perpendicular to the neutral bending axis; and at least one layer of ±45° fibers.

20. A shaft according to claim 19 wherein said ±45° fibers are glass fibers.

21. A shaft according to claim 1 wherein said sides comprise layers of bonded fibers, the fibers being oriented with respect to the longitudinal axis, said layers comprising:

at least one layer of 0° carbon fibers on the side perpendicular to the neutral bending axis;

at least one layer of 0° glass fiber on the side parallel to the neutral bending axis; and at least one layer of ±45° fiber.

22. A shaft according to claim 21 wherein said sides comprise layers of bonded fibers, the fibers being oriented with respect to the longitudinal axis, said layers further comprising:

at least one layer of 0°/90° glass fibers; and at least one layer of 0° glass fiber.

23. A shaft according to claim 1 wherein said sides comprise layers of bonded fibers, the fibers being oriented with respect to the longitudinal axis, said layers comprising:

at least one layer of 0° carbon fiber on the side perpendicular to the neutral bending axis;

at least one layer of ±45° fibers;

at least one layer of 0° fibers on the side parallel to the neutral bending axis; and at least one layer of 0°/90° fibers.

24. A shaft according to claim 23 wherein said sides comprise layers of bonded fibers, the fibers being oriented with respect to the longitudinal axis, and wherein said layers of 0°/90° fibers comprises at least one layer of 0°/90° glass fibers; and said shaft further includes at least one layer of 0° glass fiber.

25. The shaft according to claim 1 and further including resin means for bonding said fibers together.

26. The shaft according to claim 25 wherein said resin means is an epoxy.

27. The shaft of claim 26, wherein a cross-linking agent for curing the epoxy is selected from the group consisting essentially of amines, amides and anhydrides.

28. The shaft of claim 25, wherein the resin means is selected from the group consisting essentially of urethane, unsaturated polyester and vinyl ester.

29. The shaft according to claim 25 wherein said resin means is a thermoplastic.

30. A shaft according to claim 1 wherein said sides comprise layers of bonded fibers, the fibers being oriented with respect to the longitudinal axis of said shaft, said layers comprising at least one layer of 0° glass fiber on the side parallel to the neutral bending axis and 0° carbon fiber on the side perpendicular to the neutral bending axis.

31. A shaft according to claim 30 and further including at least one layer of random fibers.

32. A shaft according to claim 30 and further including at least one layer of random fibers on opposite sides of said at least one layer of 0° glass fiber on the side parallel to the neutral bending axis and 0° carbon fiber on the side perpendicular to the neutral bending axis.

33. A shaft according to claim 1, wherein said first and second pairs of sides define a hollow cavity.

34. A tubular, composite hockey stick shaft of generally uniform cross-section along a longitudinal axis thereof, said shaft comprising:

a) laminae of glass fibers;

b) a neutral bending axis;

c) a first pair of opposing sides perpendicular to said neutral bending axis; and, d) a second pair of opposing sides parallel to said neutral bending axis;

wherein said first pair of opposing sides comprise at least one layer of reinforcing fibers, and said second pair of opposing sides lack said reinforcing fibers, said first and second pair of opposing sides defining a hollow cavity.

35. The hockey stick shaft of claim 34, wherein said laminae of glass fibers and said reinforcing fibers occur in the following sequence extending from an inner surface to an outer surface:

a) a veil;

b) ±45° glass fibers;

c) 0° glass fibers and 0° carbon fiber;

d) ±45° stitched or woven glass fiber;

e) 0°/90° plain weave glass fiber;

f) 0° glass fiber and 0° carbon fiber;

g) ±45° stitched glass fiber; and, h) a veil.

36. The hockey stick shaft of claim 34, wherein said laminae of glass fibers and said reinforcing fibers occur in the following sequence extending from an inner surface to an outer surface:

a) a veil;

b) ±45° glass fiber;

c) 0° glass fiber and carbon fiber;

d) 0°/90° glass fiber;

e) 0° glass fiber and carbon fiber;

f) ±45° glass fiber; and, g) a veil.

37. The hockey stick shaft of claim 34, wherein said laminae of glass fibers and said reinforcing fibers occur in the following sequence extending from an inner surface to an outer surface:

a) a veil;

b) ±45° glass fiber;

c) 0° glass fiber and carbon fiber;

d) 0°/90° glass fiber;

e) 0° glass fiber and carbon fiber;

f) 0°/90° glass fiber; and, g) a veil.

38. The hockey stick shaft of claim 34, wherein said laminae of glass fibers and said reinforcing fibers occur in the following sequence extending from an inner surface to an outer surface:

a) a veil;

b) 0°/90° glass fiber;

c) 0° glass fiber;

d) ±45° glass fiber;

e) 0° carbon fiber;

f) ±45° glass fiber; and, g) a veil.

39. The hockey stick shaft of claim 34, wherein said laminae of glass fibers and said reinforcing fibers occur in the following sequence extending from an inner surface to an outer surface:

a) a veil;

b) ±45° glass fiber;

c) 0° carbon fiber;

d) ±45° glass fiber;

e) 0°/90° glass fiber;

f) 0° glass fiber;

g) ±45° glass fiber or 0°/90° glass fiber; and, h) a veil.

* * * * *